US007954570B2

(12) United States Patent
McClain et al.

(10) Patent No.: US 7,954,570 B2
(45) Date of Patent: Jun. 7, 2011

(54) CUTTING ELEMENTS CONFIGURED FOR CASING COMPONENT DRILLOUT AND EARTH BORING DRILL BITS INCLUDING SAME

(75) Inventors: Eric E. McClain, Spring, TX (US); John C. Thomas, Magnolia, TX (US); Sarvesh Tyagi, The Woodlands, TX (US); Jack T. Oldham, Conroe, TX (US); Lester I. Clark, The Woodlands, TX (US); William Heuser, Kuala Lumpur (MY)

(73) Assignee: Baker Hughes Incorporated, Houston, TX (US)

( * ) Notice: Subject to any disclaimer, the term of this patent is extended or adjusted under 35 U.S.C. 154(b) by 117 days.

(21) Appl. No.: 11/524,503

(22) Filed: Sep. 20, 2006

(65) Prior Publication Data

US 2007/0079995 A1 Apr. 12, 2007

Related U.S. Application Data

(63) Continuation-in-part of application No. 11/234,076, filed on Sep. 23, 2005, which is a continuation-in-part of application No. 10/783,720, filed on Feb. 19, 2004, now Pat. No. 7,395,882, and a continuation-in-part of application No. 10/916,342, filed on Aug. 10, 2004, now Pat. No. 7,178,609.

(51) Int. Cl.
*E21B 10/46* (2006.01)

(52) U.S. Cl. ..... 175/426; 175/430; 175/434

(58) Field of Classification Search ..... 175/426, 175/430, 434

See application file for complete search history.

(56) References Cited

U.S. PATENT DOCUMENTS 1,342,424 A 6/1920 Cotten (Continued)

FOREIGN PATENT DOCUMENTS

CA 1 222 448 6/1987

(Continued)

OTHER PUBLICATIONS

Partial International Search Report dated May 27, 2005 (6 pages).

(Continued)

*Primary Examiner* — William P Neuder
(74) *Attorney, Agent, or Firm* — TraskBritt

(57) ABSTRACT

A drill bit includes a bit body having a face on which two different types of cutting elements are disposed, the first type being cutting elements suitable for drilling at least one subterranean formation and the second type being cutting elements suitable for drilling through a casing bit disposed at an end of a casing or liner string and cementing equipment or other components, if such are disposed within the casing or liner string, as well as cement inside as well as exterior to the casing or liner string. The second type of cutting elements exhibits a relatively greater exposure than the first type of cutting elements, so as to engage the interior of the casing bit and, if present, cementing equipment components and cement to drill therethrough, after which the second type of cutting elements quickly wears upon engagement with the subterranean formation material exterior to the casing bit, and the first type of cutting elements continues to drill the subterranean formation. The first type of cutting elements may comprise superabrasive cutting elements and the second type of cutting elements may comprise abrasive or superabrasive cutting elements comprising a plurality of configurations.

4 Claims, 9 Drawing Sheets

U.S. PATENT DOCUMENTS

| | | | | |
|---|---|---|---|---|
| 1,981,525 | A | | 11/1934 | Price |
| 1,997,312 | A | | 4/1935 | Satre |
| 2,215,913 | A | | 9/1940 | Brown |
| 2,334,788 | A | | 11/1943 | O'Leary |
| 2,869,825 | A | | 1/1959 | Crawford |
| 2,940,731 | A | | 6/1960 | Poole |
| 3,127,945 | A | | 4/1964 | Bridwell et al. |
| 3,258,817 | A | | 7/1966 | Smiley |
| 3,266,577 | A | | 8/1966 | Turner |
| 3,367,430 | A | | 2/1968 | Rowley |
| 3,565,192 | A | | 2/1971 | McLarty |
| 3,624,760 | A | | 11/1971 | Bodine |
| 3,743,489 | A | | 7/1973 | Wentorf, Jr. |
| 3,825,083 | A | | 7/1974 | Flarity et al. |
| 3,997,009 | A | | 12/1976 | Fox |
| 4,190,383 | A | | 2/1980 | Pryke et al. |
| 4,255,165 | A | | 3/1981 | Dennis et al. |
| 4,268,276 | A | | 5/1981 | Bovenkerk |
| 4,351,401 | A | | 9/1982 | Fielder |
| 4,374,651 | A | | 2/1983 | Lee et al. |
| 4,413,682 | A | | 11/1983 | Callihan et al. |
| 4,618,010 | A | | 10/1986 | Falgout, Sr. et al. |
| 4,624,316 | A | | 11/1986 | Baldridge et al. |
| 4,673,044 | A | | 6/1987 | Bigelow et al. |
| 4,682,663 | A | | 7/1987 | Daly et al. |
| 4,702,649 | A | | 10/1987 | Komanduri |
| 4,759,413 | A | | 7/1988 | Bailey et al. |
| 4,782,903 | A | | 11/1988 | Strange |
| 4,842,081 | A | | 6/1989 | Parant |
| 4,943,488 | A | | 7/1990 | Sung et al. |
| 4,956,238 | A | | 9/1990 | Griffin |
| 4,984,642 | A | * | 1/1991 | Renard et al. ..... 175/430 |
| 5,025,874 | A | | 6/1991 | Barr et al. |
| 5,027,912 | A | | 7/1991 | Juergens |
| 5,049,164 | A | | 9/1991 | Horton et al. |
| 5,064,007 | A | * | 11/1991 | Kaalstad ..... 175/334 |
| 5,127,482 | A | | 7/1992 | Rector, Jr. |
| 5,135,061 | A | | 8/1992 | Newton, Jr. |
| 5,168,941 | A | | 12/1992 | Krueger et al. |
| 5,186,265 | A | | 2/1993 | Henson et al. |
| 5,259,469 | A | | 11/1993 | Stjernstrom et al. |
| 5,271,472 | A | | 12/1993 | Leturno |
| 5,285,204 | A | | 2/1994 | Sas-Jaworsky |
| 5,289,889 | A | | 3/1994 | Gearhart et al. |
| 5,311,954 | A | | 5/1994 | Quintana |
| 5,314,033 | A | | 5/1994 | Tibbitts |
| 5,322,138 | A | * | 6/1994 | Siracki ..... 175/374 |
| 5,322,139 | A | | 6/1994 | Rose et al. |
| 5,341,888 | A | | 8/1994 | Deschutter |
| 5,379,835 | A | | 1/1995 | Streich |
| 5,402,856 | A | | 4/1995 | Warren et al. |
| 5,423,387 | A | | 6/1995 | Lynde |
| 5,435,403 | A | | 7/1995 | Tibbitts |
| 5,443,565 | A | | 8/1995 | Strange, Jr. |
| 5,450,903 | A | | 9/1995 | Budde |
| 5,497,842 | A | | 3/1996 | Pastusek et al. |
| 5,499,688 | A | * | 3/1996 | Dennis ..... 175/426 |
| 5,531,281 | A | | 7/1996 | Murdock |
| 5,533,582 | A | | 7/1996 | Tibbitts |
| 5,566,779 | A | | 10/1996 | Dennis |
| 5,597,625 | A | | 1/1997 | Ong et al. |
| 5,605,198 | A | | 2/1997 | Tibbitts et al. |
| 5,629,053 | A | | 5/1997 | Treichel et al. |
| 5,639,551 | A | | 6/1997 | Ong et al. |
| 5,697,442 | A | | 12/1997 | Baldridge |
| 5,706,906 | A | | 1/1998 | Jurewicz et al. |
| 5,720,357 | A | | 2/1998 | Fuller et al. |
| 5,723,188 | A | | 3/1998 | Luthje et al. |
| 5,765,653 | A | | 6/1998 | Doster et al. |
| 5,787,022 | A | | 7/1998 | Tibbitts et al. |
| 5,842,517 | A | | 12/1998 | Coone |
| 5,887,655 | A | | 3/1999 | Haugen et al. |
| 5,887,668 | A | | 3/1999 | Haugen et al. |
| 5,950,747 | A | | 9/1999 | Tibbitts et al. |
| 5,957,225 | A | | 9/1999 | Sinor |
| 5,960,881 | A | | 10/1999 | Allamon et al. |
| 5,979,571 | A | | 11/1999 | Scott et al. |
| 5,992,547 | A | | 11/1999 | Caraway et al. |
| 6,009,962 | A | | 1/2000 | Beaton |
| 6,021,859 | A | | 2/2000 | Tibbitts et al. |
| 6,050,354 | A | | 4/2000 | Pessier et al. |
| 6,062,326 | A | | 5/2000 | Strong et al. |
| 6,063,502 | A | | 5/2000 | Sue et al. |
| 6,065,554 | A | | 5/2000 | Taylor et al. |
| 6,073,518 | A | | 6/2000 | Chow et al. |
| 6,098,730 | A | | 8/2000 | Scott et al. |
| 6,123,160 | A | | 9/2000 | Tibbitts |
| 6,131,675 | A | | 10/2000 | Anderson |
| 6,135,219 | A | * | 10/2000 | Scott ..... 175/432 |
| 6,216,805 | B1 | | 4/2001 | Lays et al. |
| 6,241,036 | B1 | * | 6/2001 | Lovato et al. ..... 175/432 |
| 6,298,930 | B1 | | 10/2001 | Sinor et al. |
| 6,315,065 | B1 | | 11/2001 | Yong et al. |
| 6,321,862 | B1 | | 11/2001 | Beuershausen et al. |
| 6,340,064 | B2 | | 1/2002 | Fielder et al. |
| 6,360,831 | B1 | | 3/2002 | Akesson et al. |
| 6,394,200 | B1 | | 5/2002 | Watson et al. |
| 6,401,820 | B1 | | 6/2002 | Kirk et al. |
| 6,408,958 | B1 | | 6/2002 | Isbell et al. |
| 6,412,579 | B2 | | 7/2002 | Fielder |
| 6,415,877 | B1 | | 7/2002 | Fincher et al. |
| 6,439,326 | B1 | | 8/2002 | Huang et al. |
| 6,443,247 | B1 | | 9/2002 | Wardley |
| 6,460,631 | B2 | | 10/2002 | Dykstra et al. |
| 6,484,825 | B2 | | 11/2002 | Watson et al. |
| 6,497,291 | B1 | | 12/2002 | Szarka |
| 6,499,547 | B2 | | 12/2002 | Scott et al. |
| 6,510,906 | B1 | | 1/2003 | Richert et al. |
| 6,513,606 | B1 | | 2/2003 | Krueger |
| 6,540,033 | B1 | | 4/2003 | Sullivan et al. |
| 6,543,312 | B2 | | 4/2003 | Sullivan et al. |
| 6,568,492 | B2 | | 5/2003 | Thigpen et al. |
| 6,571,886 | B1 | | 6/2003 | Sullivan et al. |
| 6,579,045 | B1 | | 6/2003 | Fries et al. |
| 6,606,923 | B2 | | 8/2003 | Hart et al. |
| 6,612,383 | B2 | | 9/2003 | Desai et al. |
| 6,620,308 | B2 | | 9/2003 | Gilbert |
| 6,620,380 | B2 | | 9/2003 | Thomas et al. |
| 6,622,803 | B2 | | 9/2003 | Harvey et al. |
| 6,626,251 | B1 | | 9/2003 | Sullivan et al. |
| 6,629,476 | B2 | | 10/2003 | Fielder et al. |
| 6,648,081 | B2 | | 11/2003 | Fincher et al. |
| 6,651,756 | B1 | | 11/2003 | Costo, Jr. et al. |
| 6,655,481 | B2 | | 12/2003 | Findley et al. |
| 6,659,173 | B2 | | 12/2003 | Kirk et al. |
| 6,672,406 | B2 | * | 1/2004 | Beuershausen ..... 175/57 |
| 6,702,040 | B1 | | 3/2004 | Sensenig |
| 6,702,045 | B1 | | 3/2004 | Elsby |
| 6,708,769 | B2 | | 3/2004 | Haugen et al. |
| 6,747,570 | B2 | | 6/2004 | Beique et al. |
| 6,779,613 | B2 | | 8/2004 | Dykstra et al. |
| 6,779,951 | B1 | | 8/2004 | Vale et al. |
| 6,817,633 | B2 | | 11/2004 | Brill et al. |
| 6,848,517 | B2 | | 2/2005 | Wardley |
| 6,857,487 | B2 | | 2/2005 | Galloway |
| 6,904,984 | B1 | * | 6/2005 | Estes et al. ..... 175/430 |
| 6,926,099 | B2 | | 8/2005 | Thigpen et al. |
| 6,953,096 | B2 | | 10/2005 | Gledhill et al. |
| 6,983,811 | B2 | | 1/2006 | Wardley |
| 7,025,156 | B1 | | 4/2006 | Caraway |
| 7,036,611 | B2 | | 5/2006 | Radford et al. |
| 7,044,241 | B2 | | 5/2006 | Angman |
| 7,066,253 | B2 | | 6/2006 | Baker |
| 7,096,982 | B2 | | 8/2006 | McKay et al. |
| 7,100,713 | B2 | | 9/2006 | Tulloch |
| 7,131,504 | B2 | | 11/2006 | Odell, II et al. |
| 7,137,460 | B2 | | 11/2006 | Slaughter |
| 7,178,609 | B2 | | 2/2007 | Hart et al. |
| 7,204,309 | B2 | | 4/2007 | Segura et al. |
| 7,216,727 | B2 | | 5/2007 | Wardley |
| 7,360,608 | B2 | | 4/2008 | Brackin et al. |
| 7,367,410 | B2 | | 5/2008 | Sangesland |
| 7,377,339 | B2 | | 5/2008 | Wassell et al. |
| 7,395,882 | B2 | | 7/2008 | Oldham et al. |
| 7,621,351 | B2 | | 11/2009 | Clark et al. |
| 7,624,818 | B2 | | 12/2009 | McClain et al. |
| 7,748,475 | B2 | | 7/2010 | McClain et al. |

| | | | | |
|---|---|---|---|---|
| 7,757,784 | B2 | 7/2010 | Fincher et al. | |
| 7,836,978 | B2 | 11/2010 | Scott | |
| 2001/0004946 | A1 | 6/2001 | Jensen | |
| 2001/0045306 | A1 | 11/2001 | Fielder et al. | |
| 2001/0047891 | A1* | 12/2001 | Truax et al. | 175/426 |
| 2002/0020565 | A1 | 2/2002 | Hart et al. | |
| 2002/0112894 | A1 | 8/2002 | Caraway | |
| 2002/0121393 | A1 | 9/2002 | Thigpen et al. | |
| 2002/0129944 | A1 | 9/2002 | Moore et al. | |
| 2002/0189863 | A1 | 12/2002 | Wardley | |
| 2003/0019106 | A1 | 1/2003 | Pope et al. | |
| 2003/0164251 | A1 | 9/2003 | Tulloch | |
| 2004/0124010 | A1 | 7/2004 | Galloway et al. | |
| 2004/0159469 | A1* | 8/2004 | Overstreet et al. | 175/374 |
| 2004/0163851 | A1* | 8/2004 | McDonough et al. | 175/374 |
| 2004/0188141 | A1 | 9/2004 | Slaughter et al. | |
| 2004/0216926 | A1 | 11/2004 | Dykstra et al. | |
| 2004/0226751 | A1 | 11/2004 | McKay et al. | |
| 2004/0245020 | A1 | 12/2004 | Giroux et al. | |
| 2005/0072565 | A1 | 4/2005 | Segura et al. | |
| 2005/0103530 | A1 | 5/2005 | Wheeler et al. | |
| 2005/0133277 | A1 | 6/2005 | Dixon | |
| 2005/0145417 | A1 | 7/2005 | Radford et al. | |
| 2005/0152749 | A1 | 7/2005 | Anres et al. | |
| 2005/0183892 | A1 | 8/2005 | Oldham et al. | |
| 2006/0016626 | A1 | 1/2006 | Lund et al. | |
| 2006/0048972 | A1 | 3/2006 | Odell et al. | |
| 2006/0070771 | A1 | 4/2006 | McClain et al. | |
| 2006/0144621 | A1 | 7/2006 | Tank et al. | |
| 2007/0029116 | A1 | 2/2007 | Keshavan | |
| 2007/0079995 | A1 | 4/2007 | McClain et al. | |
| 2007/0175672 | A1 | 8/2007 | Eyre et al. | |
| 2007/0246224 | A1 | 10/2007 | Krauss et al. | |
| 2007/0289782 | A1 | 12/2007 | Clark et al. | |
| 2008/0149393 | A1 | 6/2008 | McClain et al. | |
| 2008/0223575 | A1 | 9/2008 | Oldham et al. | |
| 2008/0245532 | A1 | 10/2008 | Rhinehart et al. | |
| 2008/0246224 | A1 | 10/2008 | Pabst et al. | |
| 2008/0308276 | A1 | 12/2008 | Scott | |
| 2008/0308321 | A1 | 12/2008 | Aliko et al. | |
| 2009/0084608 | A1 | 4/2009 | McClain et al. | |

FOREIGN PATENT DOCUMENTS

| | | | |
|---|---|---|---|
| CA | 2 411 856 | | 12/2001 |
| DE | 4432710 | C1 | 4/1996 |
| EP | 0 028 121 | A1 | 5/1981 |
| EP | 0916803 | | 6/2003 |
| EP | 1006260 | B1 | 4/2004 |
| GB | 2 086 451 | | 5/1982 |
| GB | 2 170 528 | A | 8/1986 |
| GB | 2345503 | A | 7/2000 |
| GB | 2351987 | A | 1/2001 |
| GB | 2359572 | | 8/2001 |
| GB | 2 396 870 | A | 7/2004 |
| WO | WO 93/25794 | | 12/1993 |
| WO | WO 96/28635 | | 9/1996 |
| WO | WO 98/13572 | | 4/1998 |
| WO | 9937881 | A2 | 7/1999 |
| WO | WO 9936215 | A1 | 7/1999 |
| WO | WO 00/50730 | | 8/2000 |
| WO | 0142617 | A1 | 6/2001 |
| WO | WO 01/46550 | A1 | 6/2001 |
| WO | WO0183932 | | 11/2001 |
| WO | WO 01/94738 | A1 | 12/2001 |
| WO | WO 02/46564 | A2 | 6/2002 |
| WO | WO 03/087525 | A1 | 10/2003 |
| WO | WO 2004/076800 | A1 | 9/2004 |
| WO | WO 2004/097168 | | 11/2004 |
| WO | 2005071210 | A1 | 8/2005 |
| WO | 2005083226 | A1 | 9/2005 |
| WO | WO 2007/038208 | | 4/2007 |

OTHER PUBLICATIONS

International Search Report, dated Jul. 15, 2005 (6 pages).
Written Opinion of the International Searching Authority, dated Jul. 15, 2005 (11 pages).
Greg Galloway Weatherford International, "Rotary Drilling with Casing—A Field Proven Method of Reducing Wellbore Construction Cost," World Oil Casing Drilling Technical Conference, Mar. 6-7, 2003, pp. 1-7 (WOCD-0306-02).
McKay et al, New Developments in the Technology of Drilling with Casing: Utilizing a Displaceable DrillShoe Tool, World Oil Casing Drilling Technical Conference, Mar. 6-7, 2003, pp. 1-11 (WOCD-0306-05).
U.S. Appl. No. 11/764,008, filed Jun. 15, 2007, entitled "Cutting Elements for Casing Component Drill Out and Subterranean Drilling, Earth Boring Drag Bits and Tools Including Same and Methods of Use," by Danny E. Scott.
U.S. Appl. No. 11/928,956, filed Oct. 30, 2007, entitled "Earth Boring Drill Bits with Casing Component Drill Out Capability and Methods of Use," by Eric E. McClain et al.
Baker Oil Tools Drill Down Float Shoes, 6 pages, various dates prior to May 23, 1997.
Caledus BridgeBUSTER Product Information Sheet, 3 pages, 2004.
Downhole Products plc, Davis-Lynch, Inc. Pen-o-trator, 2 pages, no date indicated.
Ray Oil Tool, The Silver Bullet Float Shoes & Collars, 2 pages, no date indicated.
Weatherford Cementation Products, BBL Reamer Shoes, 4 pages, 1998.
PCT International Search Report for PCT Application No. PCT/US2007/011543, mailed Nov. 19, 2007.
PCT International Search Report for PCT Application No. PCT/US2006/036855, mailed Feb. 1, 2007.
Random House and Collins English Dictionary's definition of "abrasive", accessed Oct. 28, 2010 at http://dictionary.reference.com.
Written Opinion mailed Feb. 2, 2009, for International Application No. PCT/US2008/066300.
Written Opinion for PCT Application No. PCT/US2006/036855, mailed Feb. 1, 2007.
Written Opinion for PCT Application No. PCT/US2007/011543, mailed Nov. 19, 2007.
International Search Report for PCT Application No. PCT/US2005/004106, mailed Jul. 15, 2005.
Written Opinion for PCT Application No. PCT/US2005/004106, mailed Jul. 15, 2005.
PCT International Search Report for PCT/US2008/078414, mailed Jul. 5, 2009, 5 pages.
PCT Written Opinion for PCT/US2008/078414, mailed Jul. 5, 2009, 5 pages.
PCT International Search Report, mailed Feb. 2, 2009, for International Application No. PCT/US2008/066300.
International Preliminary Report on Patentability for PCT/US2006/036855, dated Mar. 26, 2008.
International Preliminary Report on Patentability for PCT Application No. PCT/US2007/011543, mailed Nov. 17, 2008.
International Preliminary Report on Patentability for International Application No. PCT/US2008/066300, mailed Dec. 17, 2009.

* cited by examiner

CUTTING ELEMENTS CONFIGURED FOR CASING COMPONENT DRILLOUT AND EARTH BORING DRILL BITS INCLUDING SAME

CROSS-REFERENCE TO RELATED APPLICATIONS

This application is a continuation-in-part of U.S. patent application Ser. No. 11/234,076, filed Sep. 23, 2005, now U.S. Pat. No. 7,624,818, issued Dec. 1, 2009, which is a continuation-in-part of U.S. patent application Ser. No. 10/783,720, filed Feb. 19, 2004, now U.S. Pat. No. 7,395,882, issued Jul. 8, 2008, and a continuation-in-part of U.S. patent application Ser. No. 10/916,342, filed Aug. 10, 2004, now U.S. Pat. No. 7,178,609, issued Feb. 20, 2007. The disclosure of each of the foregoing patents and applications is incorporated herein in its entirety by reference.

BACKGROUND OF THE INVENTION

1. Field of the Invention

The present invention relates generally to drilling a subterranean borehole and, more specifically, to drill bits for drilling subterranean formations and having a capability for drilling out structures and materials which may be located at or proximate the end of a casing or liner string, such as a casing bit or shoe, cementing equipment components and cement.

2. State of the Art

The drilling of wells for oil and gas production conventionally employs longitudinally extending sections or so-called "strings" of drill pipe to which, at one end, is secured a drill bit of a larger diameter. After a selected portion of the borehole has been drilled, the borehole is usually lined or cased with a string or section of casing. Such a casing or liner usually exhibits a larger diameter than the drill pipe and a smaller diameter than the drill bit. Therefore, drilling and casing according to the conventional process typically requires sequentially drilling the borehole using drill string with a drill bit attached thereto, removing the drill string and drill bit from the borehole, and disposing casing into the borehole. Further, often after a section of the borehole is lined with casing, which is usually cemented into place, additional drilling beyond the end of the casing may be desired.

Unfortunately, sequential drilling and casing may be time consuming because, as may be appreciated, at the considerable depths reached during oil and gas production, the time required to implement complex retrieval procedures to recover the drill string may be considerable. Thus, such operations may be costly as well, since, for example, the beginning of profitable production can be greatly delayed. Moreover, control of the well may be difficult during the period of time that the drill pipe is being removed and the casing is being disposed into the borehole.

Some approaches have been developed to address the difficulties associated with conventional drilling and casing operations. Of initial interest is an apparatus, which is known as a reamer shoe that has been used in conventional drilling operations. Reamer shoes have become available relatively recently and are devices that are able to drill through modest obstructions within a borehole that has been previously drilled. In addition, the reamer shoe may include an inner section manufactured from a material that is drillable by drill bits. Accordingly, when cemented into place, reamer shoes usually pose no difficulty to a subsequent drill bit. For instance, U.S. Pat. No. 6,062,326 to Strong et al. discloses a casing shoe or reamer shoe in which the central portion thereof may be configured to be drilled through. In addition, U.S. Pat. No. 6,062,326 to Strong et al. discloses a casing shoe that may include diamond cutters over the entire face thereof, if it is not desired to drill therethrough.

As a further extension of the reamer shoe concept, in order to address the problems with sequential drilling and casing, drilling with casing is gaining popularity as a method for initially drilling a borehole, wherein the casing is used as the drilling conduit and, after drilling, the casing remains downhole to act as the borehole casing. Drilling with casing employs a conventional drill bit attached to the casing string, so that the drill bit functions not only to drill the earth formation, but also to guide the casing into the wellbore. This may be advantageous as the casing is disposed into the borehole as it is formed by the drill bit, and therefore eliminates the necessity of retrieving the drill string and drill bit after reaching a target depth where cementing is desired.

While this procedure greatly increases the efficiency of the drilling procedure, a further problem is encountered when the casing is cemented upon reaching the desired depth. While one advantage of drilling with casing is that the drill bit does not have to be retrieved from the wellbore, further drilling may be required. For instance, cementing may be done for isolating certain subterranean strata from one another along a particular extent of the wellbore, but not at the desired depth. Thus, further drilling must pass through or around the drill bit attached to the end of the casing.

In the case of a casing shoe that is drillable, further drilling may be accomplished with a smaller diameter drill bit and casing section attached thereto that passes through the interior of the first casing to drill the further section of hole beyond the previously attained depth. Of course, cementing and further drilling may be repeated as necessary, with correspondingly smaller and smaller components, until the desired depth of the wellbore is achieved.

However, drilling through the previous drill bit in order to advance may be difficult, as drill bits are required to remove rock from formations and, accordingly, often include very drilling resistant, robust structures typically manufactured from materials such as tungsten carbide, polycrystalline diamond, or steel. Attempting to drill through a drill bit affixed to the end of a casing may result in damage to the subsequent drill bit and bottom-hole assembly deployed or possibly the casing itself. It may be possible to drill through a drill bit or a casing with special tools known as mills, but these tools are unable to penetrate rock formations effectively and the mill would have to be retrieved or "tripped" from the hole and replaced with a drill bit. In this case, the time and expense saved by drilling with casing would have been lost. One apparatus for avoiding tripping of a window mill used to drill through a whipstock set in casing is disclosed in U.S. Pat. No. 7,178,609, referenced above, from which priority is claimed and the disclosure of which is incorporated herein by reference. However, other approaches have been developed for use in other situations to allow for intermittent cementing in combination with further drilling.

In one approach, a drilling assembly, including a drill bit and one or more hole enlargement tool such as, for example, an underreamer, is used which drills a borehole of sufficient diameter to accommodate the casing. The drilling assembly is disposed on the advancing end of the casing. The drill bit can be retractable, removable, or both, from the casing. For example, U.S. Pat. No. 5,271,472 to Letumo discloses a drill bit assembly comprising a retrievable central bit insertable in an outer reamer bit and engageable therewith by releasable lock means, which may be pressure fluid operated by the drilling fluid. Upon completion of drilling operations, the motor and central retrievable bit portion may be removed from the wellbore so that further wellbore operations, such as cementing of the drillstring or casing in place, may be carried out or further wellbore extending or drilling operations may be conducted. Since the central portion of the drill bit is removable, it may include relatively robust materials that are designed to withstand the rigors of a downhole environment, such as, for example, tungsten carbide, diamond, or both. However, such a configuration may not be desirable since, prior to performing the cementing operation, the drill bit has to be removed from the wellbore and thus the time and expense to remove the drill bit is not eliminated.

Another approach for drilling with casing involves a casing drilling shoe or bit adapted for attachment to a casing string, wherein the drill bit comprises an outer drilling section constructed of a relatively hard material and an inner section constructed of a drillable material. For instance, U.S. Pat. No. 6,443,247 to Wardley discloses a casing drilling shoe comprising an outer drilling section constructed of relatively hard material and an inner section constructed of a drillable material such as aluminum. In addition, the outer drilling section may be displaceable, so as to allow the casing shoe to be drilled through using a standard drill bit.

Also, U.S. Patent Application 2002/0189863 to Wardley discloses a drill bit for drilling casing into a borehole, wherein the proportions of materials are selected such that the drill bit provides suitable cutting and boring of the wellbore while being able to be drilled through by a subsequent drill bit. Also disclosed is a hard-wearing material coating applied to the casing shoe as well as methods for applying the same.

However, a casing drilling shoe or bit as described in the above patent and application to Wardley may be unduly complex, require careful selection of combinations of materials including easily drillable materials and, thus, may be undesirably expensive to manufacture.

Casing bits as disclosed and claimed in U.S. Pat. No. 7,395,882, referenced above, from which priority is claimed and which is incorporated by reference herein, have addressed many of the deficiencies associated with the Wardley structures.

However, to enable the manufacture of a casing bit (or casing shoe) from a robust, inexpensive and easily worked material such as, for example, steel or other materials which are generally non-drillable by superabrasive cutting elements, it would be desirable to have a drill bit offering the capability of drilling through such a casing bit and, if employed, other components disposed in a casing or liner string thereabove as well as cement, yet offering the formation drilling capabilities of a conventional drill bit employing superabrasive cutting elements.

BRIEF SUMMARY OF THE INVENTION

The present invention contemplates a drill bit configured for drilling through a casing bit into a subterranean formation, and continuing the drilling operation without tripping the drill string. The drill bit of the present invention may include a connection structure for connecting the drill bit to a drill string and a body which may, in one embodiment, bear a plurality of generally radially extending blades disposed on a face thereof, wherein at least one of the plurality of blades carries at least one cutting element adapted for drilling a subterranean formation and at least another cutting element having a greater exposure than the at least one cutting element and adapted for drilling through a casing bit and, if employed, cementing equipment components disposed in a casing or liner string above the casing bit and in which the drill bit of the present invention is run, as well as cement inside and exterior to the casing or liner string.

In one embodiment, the present invention contemplates that a first plurality of superabrasive cutting elements disposed upon a drill bit may exhibit an exposure and a second plurality of abrasive cutting elements disposed thereon may exhibit an exposure greater than the exposure of the first plurality of cutting elements. The second plurality of abrasive cutting elements may be configured, located and oriented, and exhibit the aforementioned greater exposure to initially engage and drill through materials and regions of the casing bit, cementing equipment and cement used to secure and seal a casing or liner string within a wellbore, and that are different from subsequent materials and regions of subterranean formations ahead of, and exterior to, the casing bit in the intended path of the wellbore and that the first plurality of superabrasive cutting elements is configured, located and oriented to engage and drill through. Particularly, the second plurality of abrasive cutting elements may comprise, for example, tungsten carbide cutting elements and the first plurality of superabrasive cutting elements may comprise, for example, polycrystalline diamond compact (PDC) cutting elements.

In another embodiment, the second plurality of cutting elements may include superabrasive materials in the form of, by way of non-limiting example, superabrasive-impregnated cutting elements, wear knots impregnated with superabrasive material, and wear knots including natural diamond. As used herein, the term "cutting elements" encompasses abrasive structures, superabrasive structures and structures including both abrasive and superabrasive materials, which exhibit a cutting capability, regardless of whether or not they are configured as conventional cutting elements.

In yet another embodiment, cutting elements of the second plurality may exhibit configurations comprising multiple cutting edges at differing degrees of exposure, cutting faces of such cutting elements comprising, by way of non-limiting example, 90° steps, 45° steps, jagged, tooth-like steps, or a scalloped configuration. Alternatively, cutting faces of such cutting elements may comprise a single, or multiple, bevels or chamfers.

In other embodiments, cutting elements of the second plurality may comprise a ductile core, such as steel, bearing a wear-resistant coating, such as tungsten carbide or titanium nitride. In still other embodiments, cutting elements of the second plurality may comprise a cutting structure supported from the rear by a gusset or buttress, or comprise a plurality of laterally adjacent, integral cutting faces.

In a further embodiment, cutting structures may incorporate both a first cutting element portion exhibiting a first exposure and a second cutting element portion exhibiting a second, greater exposure.

The present invention also contemplates a drill bit configured as a reamer as well as a casing bit, including a casing bit that is configured as a reamer. More particularly, the drill bit or casing bit reamer of the present invention may include a pilot drill bit at the lower longitudinal end thereof and an upper reaming structure that is centered with respect to the pilot drill bit and includes a plurality of blades spaced about a substantial portion of the circumference, or periphery, of the reamer. Alternatively, the drill bit or casing bit reamer of the present invention may be configured as a bicenter bit assembly, which employs two longitudinally superimposed bit sections with laterally offset axes in which usually a first, lower and smaller diameter pilot bit section is employed to commence the drilling, and rotation of the pilot bit section may cause the rotational axis of the bit assembly to transition from a pass-through diameter to a reaming diameter.

The present invention also encompasses configurations for cutting elements particularly suitable for drilling casing components, cementing equipment components, and cement.

Other features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

In the drawings, which illustrate what is currently considered to be the best mode for carrying out the invention:

FIGS.

FIGS. 6A-6H show schematically other configurations of cutting elements suitable for drilling through a casing bit and/or, if present, cementing equipment components and associated materials within a casing, wherein FIGS. 6A, 6C, 6E and 6G show transverse configurations of the cutting elements, and FIGS. 6B, 6D, 6F and 6H show side views;

DETAILED DESCRIPTION OF THE INVENTION

Figure 1:
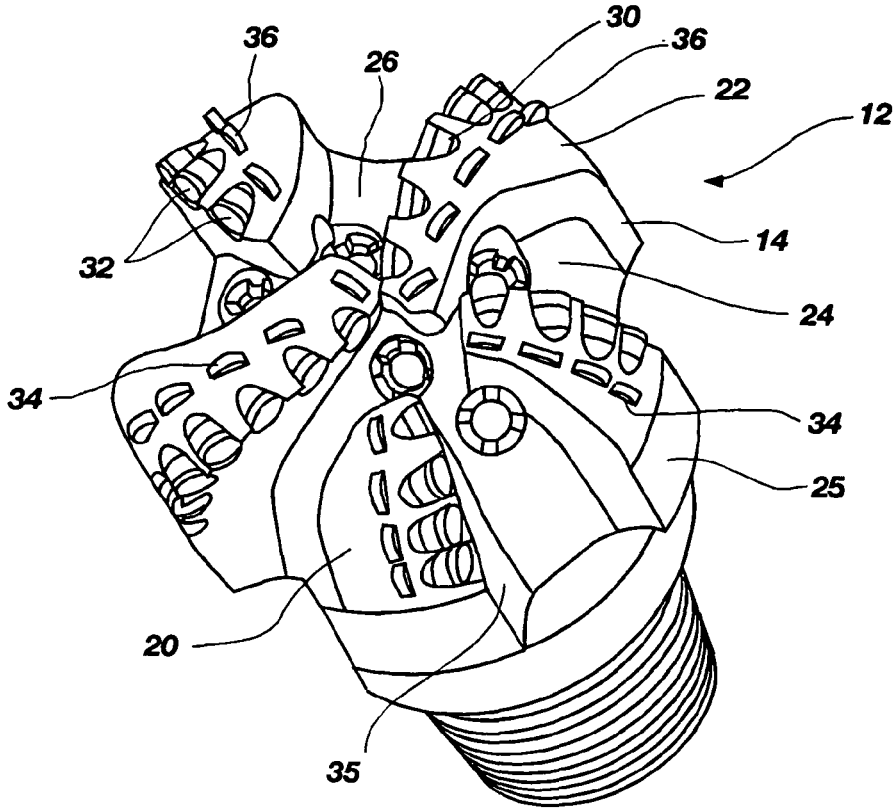
FIG. 1 shows a perspective view of a drill bit of the present invention.
Figure 2:
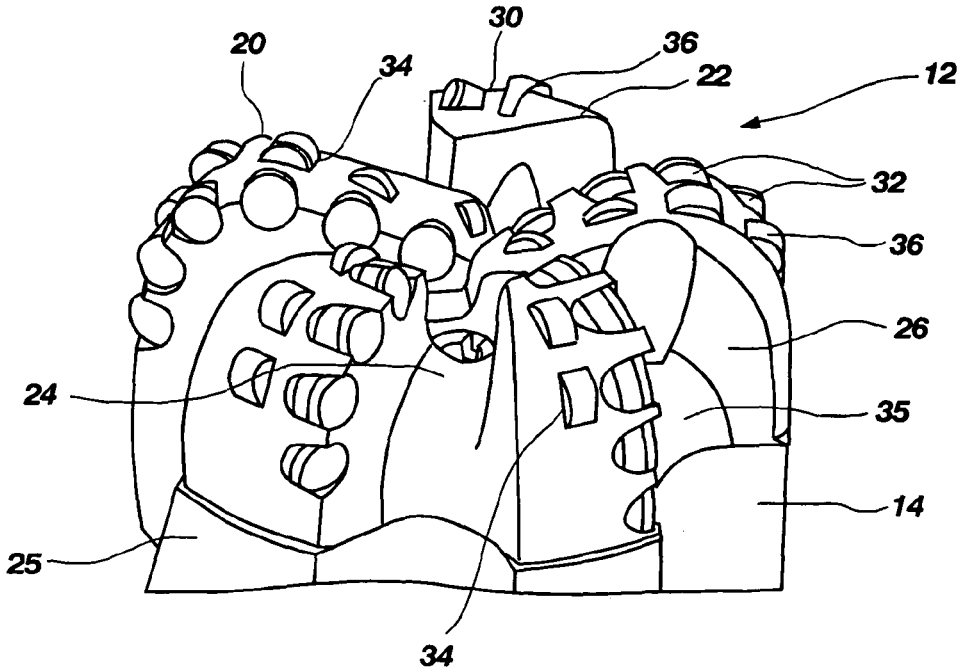
FIG. 2 shows an enlarged perspective view of a portion of another drill bit of the present invention.
Figure 3:
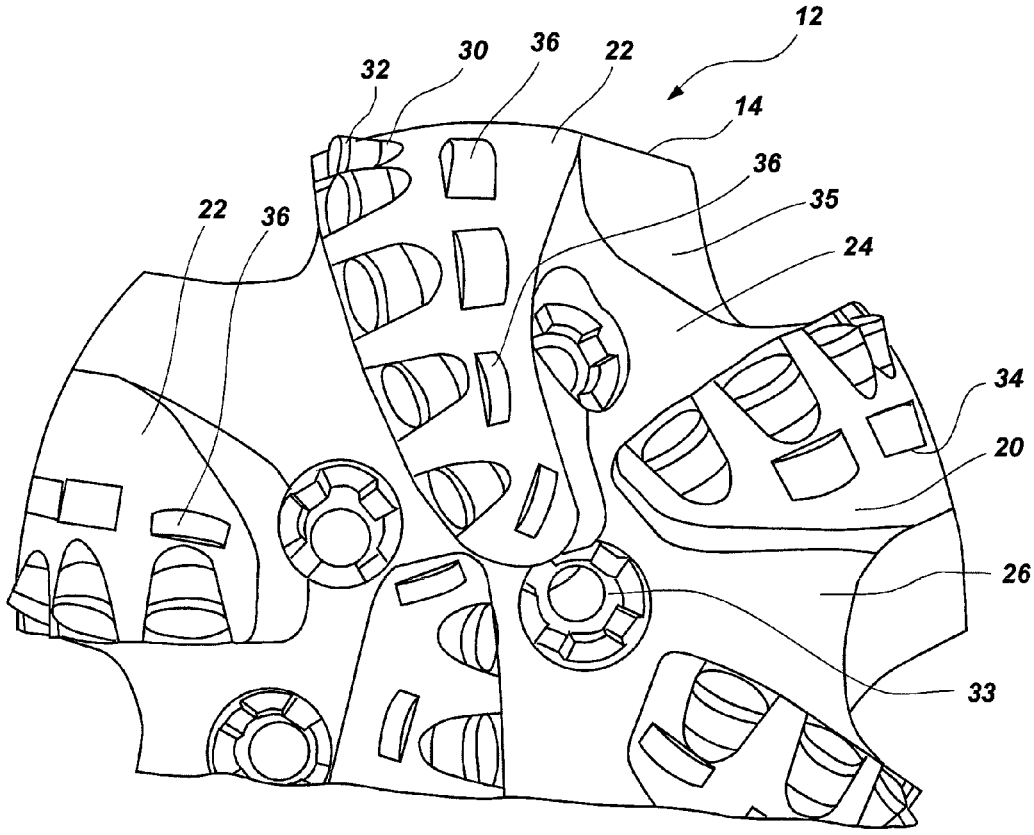
FIG. 3 shows an enlarged view of the face of the drill bit of FIG. 2.

FIGS. 1-3 illustrate several variations of an embodiment of a drill bit 12 in the form of a fixed cutter or so-called "drag" bit, according to the present invention. For the sake of clarity, like numerals have been used to identify like features in FIGS. 1-3. As shown in FIG. 1-3, drill bit 12 includes a body 14 having a face 26 and generally radially extending blades 22, forming fluid courses 24 therebetween extending to junk slots 35 between circumferentially adjacent blades 22. Bit body 14 may comprise a tungsten carbide matrix or a steel body, both as well known in the art. Blades 22 may also include pockets 30, which may be configured to receive cutting elements of one type such as, for instance, superabrasive cutting elements in the form of PDC cutting elements 32. Generally, such a PDC cutting element may comprise a superabrasive region that is bonded to a substrate. Rotary drag bits employing PDC cutting elements have been employed for several decades. PDC cutting elements are typically comprised of a disc-shaped diamond "table" formed on and bonded under a high-pressure and high-temperature (HPHT) process to a supporting substrate such as cemented tungsten carbide (WC), although other configurations are known. Drill bits carrying PDC cutting elements, which, for example, may be brazed into pockets in the bit face, pockets in blades extending from the face, or mounted to studs inserted into the bit body, are known in the art. Thus, PDC cutting elements 32 may be affixed upon the blades 22 of drill bit 12 by way of brazing, welding, or as otherwise known in the art. If PDC cutting elements 32 are employed, they may be back raked at a constant, or at varying angles. For example, PDC cutting elements 32 may be back raked at 15° within the cone, proximate the centerline of the bit, at 20° over the nose and shoulder, and at 30° at the gage. It is also contemplated that cutting elements 32 may comprise suitably mounted and exposed natural diamonds, thermally stable polycrystalline diamond compacts, cubic boron nitride compacts, or diamond grit-impregnated segments, as known in the art and as may be selected in consideration of the subterranean formation or formations to be drilled.

Also, each of blades 22 may include a gage region 25, which is configured to define the outermost radius of the drill bit 12 and, thus the radius of the wall surface of a borehole drilled thereby. Gage regions 25 comprise longitudinally upward (as the drill bit 12 is oriented during use) extensions of blades 22, extending from nose portion 20 and may have wear-resistant inserts or coatings, such as cutting elements in the form of gage trimmers of natural or synthetic diamond, or hardfacing material, on radially outer surfaces thereof as known in the art to inhibit excessive wear thereto.

Drill bit 12 may also be provided with, for example, pockets 34 in blades 22, which may be configured to receive abrasive cutting elements 36 of another type different from the first type such as, for instance, tungsten carbide cutting elements. It is also contemplated, however, that abrasive cutting elements 36 may comprise, for example, a carbide material other than tungsten (W) carbide, such as a Ti, Mo, Nb, V, Hf, Ta, Cr, Zr, Al, and Si carbide, or a ceramic. Abrasive cutting elements 36 may be secured within pockets 34 by welding, brazing or as otherwise known in the art. As depicted in FIG. 1, abrasive cutting elements 36 may be of substantially uniform thickness, taken in the direction of intended bit rotation. One suitable and non-limiting depth or thickness for abrasive cutting elements 36 is 0.175 inch. As shown in FIGS. 2 and 3, abrasive cutting elements 36 may be of varying thickness, taken in the direction of bit rotation, wherein abrasive cutting elements 36 at more radially outwardly locations (and, thus, which traverse relatively greater distance for each rotation of drill bit 12 than those, for example, within the cone of dill bit 12) may be thicker to ensure adequate material thereof will remain for cutting casing components and cement until they are to be worn away by contact with formation material after the casing components and cement are penetrated. For example, abrasive cutting elements within the cone of drill bit 12 may be of 0.175 inch depth or thickness, while those at more radially outward locations may be of 0.25 inch thickness. It is desirable to select or tailor the thickness or thicknesses of abrasive cutting elements 36 to provide sufficient material therein to cut through a casing bit or other structure between the interior of the casing and the surrounding formation to be drilled without incurring any substantial and potentially damaging contact of superabrasive cutting elements 32 with the casing bit or other structure.

Also as shown in FIGS. 1-3, abrasive cutting elements 36 may be placed in an area from the cone of the bit out to the shoulder (in the area from the centerline L to gage regions 25) to provide maximum protection for cutting elements 32, which are highly susceptible to damage when drilling casing assembly components. Abrasive cutting elements may be back raked, for example, at an angle of 5°. Broadly, cutting elements 32 on face 26, which may be defined as surfaces at less than 90° profile angles, or angles with respect to centerline L, are desirably protected. Cutting elements 36 may also be placed selectively along the profile of the face 26 to provide enhanced protection to certain areas of the face and cutting elements 32 thereon.

Superabrasive cutting elements 32 and abrasive cutting elements 36 may be respectively dimensioned and configured, in combination with the respective depths and locations of pockets 30 and 34, to provide abrasive cutting elements 36 with a greater relative exposure than superabrasive cutting elements 32. As used herein, the term "exposure" of a cutting element generally indicates its distance of protrusion above a portion of a drill bit, for example a blade surface or the profile thereof, to which it is mounted. However, in reference specifically to the present invention, "relative exposure" is used to denote a difference in exposure between a cutting element 32 of the one type and a cutting element 36 of the another, different type. More specifically, the term "relative exposure" may be used to denote a difference in exposure between one cutting element 32 of the one type and another cutting element 36 of the another, different type which are proximately located on drill bit 12 at similar radial positions relative to a centerline L (see FIG. 4) of drill bit 12 and which, optionally, may be proximately located in a direction of bit rotation. In the embodiment depicted in FIGS. 1-3, abrasive cutting elements 36 may generally be described as rotationally "following" superabrasive cutting elements 32 and in close rotational proximity on the same blade 22, as well as being located at substantially the same radius. However, abrasive cutting elements 36 may also be located to rotationally "lead" associated superabrasive cutting elements 32.

Figure 4:
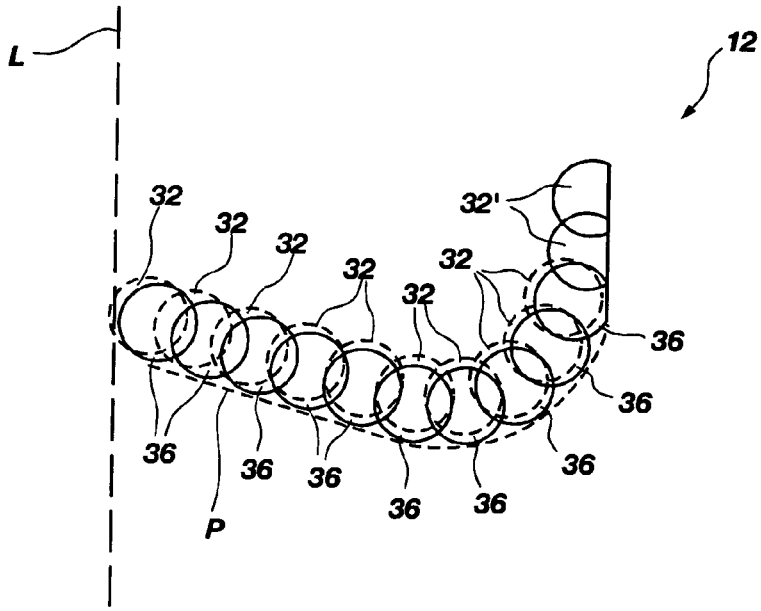
FIG. 4 shows a schematic side cross-sectional view of a cutting element placement design of a drill bit according to the present invention showing relative exposures of first and second types of cutting elements disposed thereon.
Figure 5A:
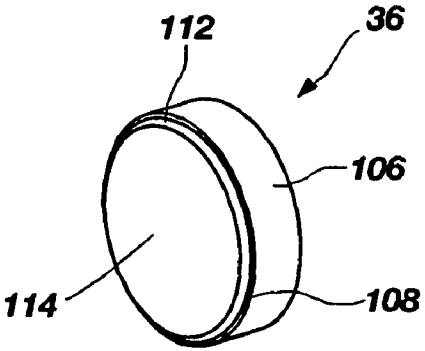
FIG. 5A is a perspective view of one configuration of a cutting element suitable for drilling through a casing bit and, if present, cementing equipment components within a casing above the casing bit.
Figure 5B:
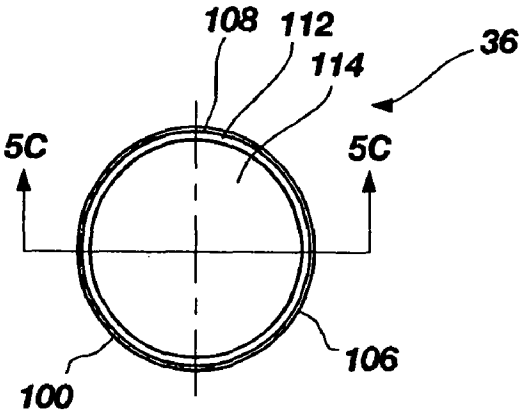
FIG. 5B is a frontal view of the cutting element.
Figure 5C:
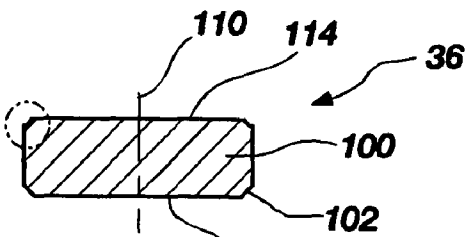
FIG. 5C is a sectional view taken through line 5C-5C on FIG. 5B.
Figure 5D:
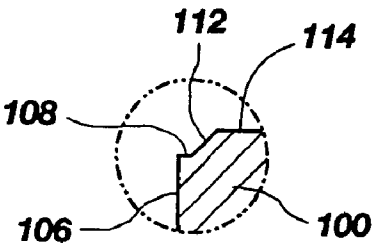
FIG. 5D is an enlarged view of the cutting edge of the cutting element in the circled area of FIG. 5C.

By way of illustration of the foregoing, FIG. 4 shows a schematic side view of a cutting element placement design for drill bit 12 showing cutting elements 32, 32' and 36 as disposed on a drill bit (not shown) such as drill bit 12 of the present invention in relation to the longitudinal axis or centerline L and drilling profile P thereof, as if all the cutting elements 32, 32', and 36 were rotated onto a single blade (not shown). Particularly, one plurality of cutting elements 36 may be sized, configured, and positioned so as to engage and drill a first material or region, such as a casing shoe, casing bit, cementing equipment component or other downhole component. Further, the one plurality of cutting elements 36 may be configured to drill through a region of cement that surrounds a casing shoe, if it has been cemented within a wellbore, as known in the art. In addition, another plurality of cutting elements 32 may be sized, configured, and positioned to drill into a subterranean formation. Also, cutting elements 32' are shown as configured with radially outwardly oriented flats and positioned to cut a gage diameter of drill bit 12, but the gage region of the cutting element placement design for drill bit 12 may also include cutting elements 32 and 36 of the first and second plurality, respectively. The present invention contemplates that the one plurality of cutting elements 36 may be more exposed than the another plurality of cutting elements 32. In this way, the one plurality of cutting elements 36 may be sacrificial in relation to the another plurality of cutting elements 32. Explaining further, the one plurality of cutting elements 36 may be configured to initially engage and drill through materials and regions that are different from subsequent materials and regions that the another plurality of cutting elements 32 is configured to engage and drill through.

Accordingly, the one plurality of cutting elements 36 may be configured differently than the another plurality of cutting elements 32. Particularly, and as noted above, the one plurality of cutting elements 36 may comprise tungsten carbide cutting elements, while the another plurality of cutting elements 32 may comprise PDC cutting elements. Such a configuration may facilitate drilling through a casing shoe or bit as well as cementing equipment components within the casing on which the casing shoe or bit is disposed as well as the cement thereabout with primarily the one plurality of cutting elements 36. However, upon passing into a subterranean formation, the abrasiveness of the subterranean formation material being drilled may wear away the tungsten carbide of cutting elements 36, and the another plurality of PDC cutting elements 32 may engage the formation. As shown in FIGS. 1-3, one or more of the another plurality of cutting elements 32 may rotationally precede one or more of the one plurality of cutting elements 36, without limitation. Alternatively, one or more of the another plurality of cutting elements 32 may rotationally follow one or more of the one plurality of cutting elements 36, without limitation.

Notably, after the tungsten carbide of cutting elements 36 has been worn away by the abrasiveness of the subterranean formation material being drilled, the PDC cutting elements 32 are relieved and may drill more efficiently. Further, it is believed that the worn cutting elements 36 may function as backups for the PDC cutting elements 36, riding generally in the paths cut in the formation material by the PDC cutting elements 36 and enhancing stability of the drill bit 12, enabling increased life of these cutting elements and consequent enhanced durability and drilling efficiency of drill bit 12.

During drilling with drill bit 12, fluid courses 24 between circumferentially adjacent blades 22 may be provided with drilling fluid flowing through nozzles 33 secured in apertures at the outer ends of passages that extend between the interior of the drill bit 12 and the face 26 thereof. Cuttings of material from engagement of cutting elements 32 or 36 are swept away from the cutting elements 32 and 36 and cutting elements 32 and 36 are cooled by drilling fluid or mud pumped down the bore of a drill string on which drill bit 12 is disposed and emanating from nozzles 33, the fluid moving generally radially outwardly through fluid courses 24 and then upwardly through junk slots 35 to an annulus between an interior wall of a casing section within which the drill bit 12 is suspended and the exterior of a drill string on which drill bit 12 is disposed. Of course, after drill bit 12 has drilled through the end of the casing assembly, an annulus is formed between the exterior of the drill string and the surrounding wall of the borehole.

FIGS. 5A-5D depict one example of a suitable configuration for cutting elements 36, including a disc-like body 100 of tungsten carbide or other suitable material and having a circumferential chamfer 102 at the rear (taken in the direction of intended cutter movement) thereof, surrounding a flat rear surface 104. A cylindrical side surface 106 extends from chamfer 102 to an annular flat 108 oriented perpendicular to longitudinal axis 110 and extending inwardly to offset chamfer 112, which leads to flat cutting face 114. An area from the junction of side surface 106 with annular flat 108 to the junction of offset chamfer 112 with cutting face 114 may be generally termed the cutting edge area, for the sake of convenience. The angles of chamfer 102 and offset chamfer 112 may be, for example, 45° to longitudinal axis 110. However, other angles are contemplated and a specific angle is not limiting of the present invention. Cutting elements 36 may be disposed on the face 26 (as on blades 22) of drill bit 12 at, for example, a forward rake, a neutral (about 0°) rake or a back rake of up to about 25°, for effective cutting of a casing shoe, casing bit, cementing equipment components, and cement, although a specific range of back rakes for cutting elements 36 is not limiting of the present invention.

Figure 6A:
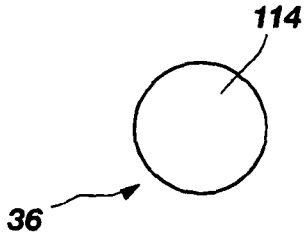
Figure 6B:
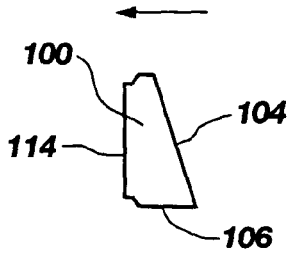
Figure 6C:
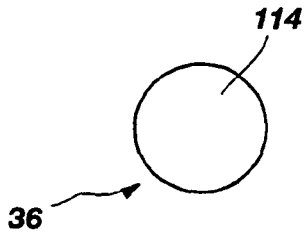
Figure 6D:
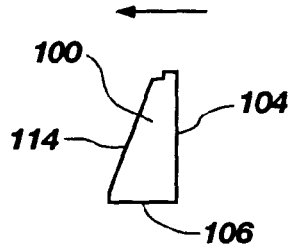
Figure 6E:
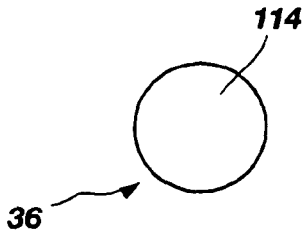
Figure 6F:
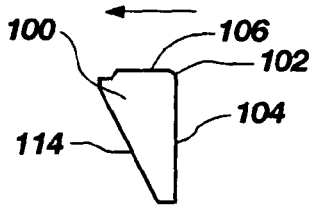
Figure 6G:
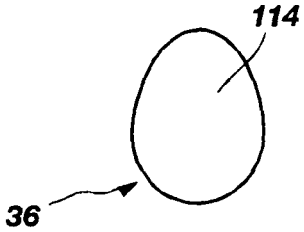
Figure 6H:
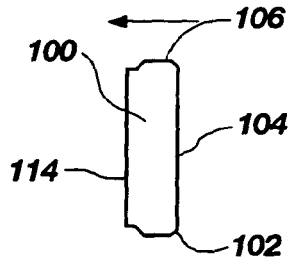

FIGS. 6A-6H depict other suitable configurations for cutting elements 36. The cutting element 36 depicted in FIGS. 6A and 6B is circular in transverse configuration and, as shown in FIG. 6B, has a cutting edge area configured similar to that of cutting element 36 depicted in FIGS. 5A-5D. However, rear surface 104 is sloped toward the front of the cutting element 36 (in the intended cutting direction shown by the arrow), providing a thicker base and a thinner outer edge for cutting, to enhance faster wear when formation material is engaged. The cutting element 36 depicted in FIGS. 6C and 6D is also circular in transverse configuration and, as shown in FIG. 6D, has a cutting edge area configured similar to that of cutting element 36 depicted in FIGS. 5A-5D. However, rear surface cutting face 114 is sloped toward the rear of the cutting element 36, providing a thicker base and a thinner outer edge for cutting, to enhance faster wear when formation material is engaged. The cutting element 36 depicted in FIGS. 6E and 6F is also circular in transverse configuration and, as shown in FIG. 6F, has a cutting edge area configuration similar to that of cutting element 36 depicted in FIGS. 5A-5D. However, cutting face 114 is sloped toward the rear of the cutting element 36 from the cutting edge area, providing a thinner base and a thicker outer edge for cutting, to provide more cutting element material for extended cutting of casing components and the like. The cutting element 36 depicted in FIGS. 6G and 6H is ovoid or egg-shaped in transverse configuration and, as shown in FIG. 6H, has a cutting edge area similar to that of cutting element 36 depicted in FIGS. 5A-5D. Cutting face 114 and rear surface 104 are mutually parallel. The ovoid configuration provides enhanced loading of material being cut by the cutting element 36, to facilitate initial engagement thereby.

Figure 7A:
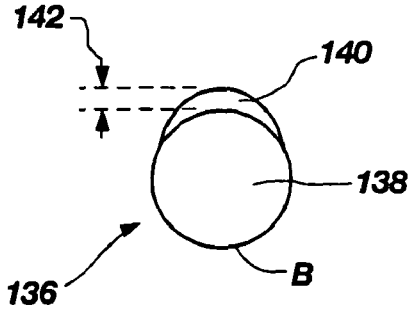
FIGS. 7A and 7B show a configuration of a dual-purpose cutting element suitable for first drilling through a casing bit and/or, if present, cementing equipment components and associated materials within a casing and subsequently drilling through a subterranean formation ahead of the casing bit.
Figure 7B:
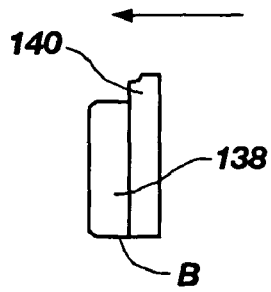

FIGS. 7A and 7B depict a cutting element 136 which may be disposed on a drill bit 12 (FIGS. 1-3) to cut casing-associated components as well as a subterranean formation, rather than using separate cutting elements for cutting casing-associated components and, subsequently, the subterranean formation. Cutting element 136 comprises a superabrasive element 138 bonded to an abrasive element 140, the outer transverse configuration of cutting element 136 being defined as an ovoid by abrasive element 140, superabrasive element 138 being of circular configuration and offset toward the base B of cutting element 136 to be tangentially aligned at the base B with abrasive element 140. Thus, an exposure of an outer extent of abrasive element 140 is greater than an exposure of an outer extent of superabrasive element 138, as shown at 142. The cutting edge area of element 140 maybe, as shown in FIG. 7B, configured similarly to that of cutting element 36 depicted in FIGS. 5A and 5B. As cutting element 136 is mounted to a drill bit with the base B received in a single pocket on the bit face, the greater exposure of abrasive element 140 will enable it to contact casing-associated components (casing shoe, casing bit, cementing equipment and cement, etc.) and drill therethrough, after which engagement of abrasive element 140 with subterranean formation material will case it to wear quickly and result in engagement of superabrasive element 138 with the formation.

Figure 11A:
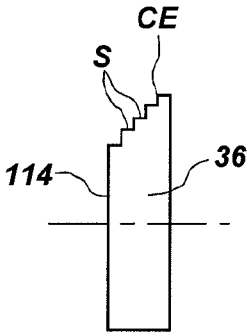
FIGS. 11A-11E are side elevations of embodiments of cutting elements suitable for drilling through a casing bit and/or, if present, cementing equipment components and associated materials within a casing.
Figure 11B:
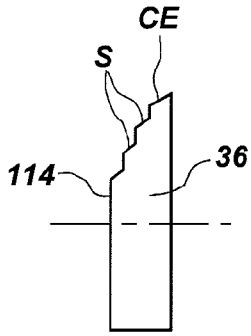
Figure 11C:
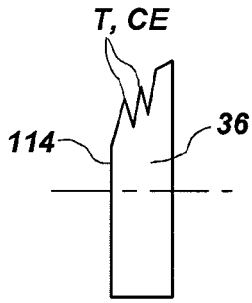
Figure 11D:
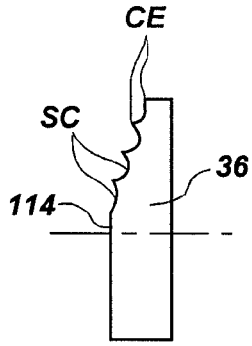
Figure 11E:
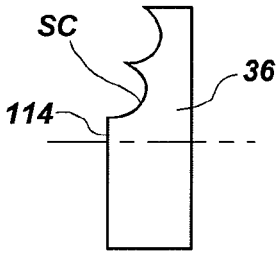

FIGS. 11A-11E depict additional embodiments of cutting elements 36 according to the invention which incorporate multiple cutting edges for enhanced efficiency in milling steel and other metallic materials encountered in penetrating a casing shoe or other casing components. As shown in broken lines in each figure, the cutting elements 36 may be received in pockets extending below the bit face. These embodiments of cutting elements 36, as with other embodiments, may be of circular or other (ovoid, rectangular, tombstone, etc.) suitable cross-sectional configuration. FIG. 11A depicts a cutting element 36 including a plurality of 90° steps S on a cutting face 114 thereof, providing cutting edges CE which are sequentially exposed to engage the material being cut as cutting element 36 wears. Such a configuration provides a relatively high stress concentration when a given cutting edge CE engages material being cut. FIG. 11B depicts a similar configuration, wherein steps S are disposed at 45° angles, which provides a relatively lower stress concentration than the 90° steps of FIG. 11A. FIG. 11C depicts a cutting element 36 exhibiting a series of teeth T, providing cutting edges CE, which are sequentially exposed by cutting element wear. FIG. 11D depicts a cutting element 36 having a plurality of scallops SC on cutting face 114, providing a plurality of cutting edges CE. FIG. 11E depicts a cutting element 36 of similar configuration to that of FIG. 11D, but employing larger, or extended, scallops SC which may function as "chip breakers" to fragment or comminute cuttings of casing material or other material being drilled through which might otherwise be sheared by cutting elements 36 into elongated chips difficult to hydraulically clear from the wellbore with circulating drilling fluid.

Figure 12:
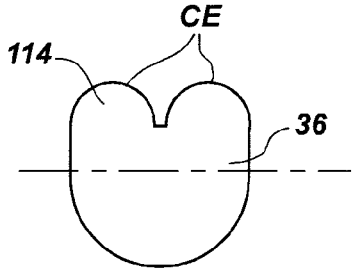
FIG. 12 is a frontal elevation of a cutting element exhibiting multiple laterally adjacent cutting edges and suitable for drilling through a casing bit and/or, if present, cementing equipment components and associated materials within a casing.

FIG. 12 depicts yet another embodiment of cutting element 36, wherein multiple, laterally adjacent cutting edges CE are provided on the same cutting face 114. Such an arrangement may be highly useful, particularly in the relative crowded cone area of a drill bit 12, to provide multiple, closely spaced points of engagement with casing components and associated materials being drilled without the use of an excessive number of cutting elements 36, which might later compromise drilling efficiency of cutting elements 23.

Figure 13A:
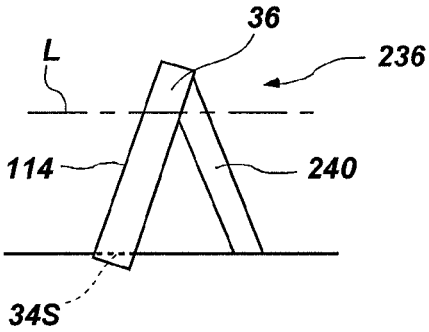
FIGS. 13A and 13B are, respectively, side and frontal elevations of a cutting element suitable for drilling through a casing bit and/or, if present, cementing equipment components and associated materials within a casing.
Figure 13B:
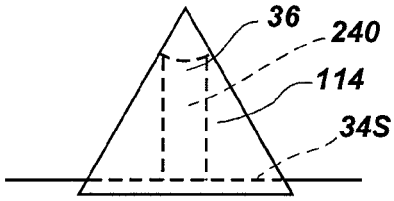

FIGS. 13A and 13B depict yet another embodiment of cutting element 236 for drilling casing components and associated material. Cutting element 236 comprises a cutting structure comprising, for example, a cutting element 36 as depicted and described with respect to any of FIGS. 5A-5D, 6A-6H, 11A-11E, and 12 or, as depicted in FIG. 13B, cutting element 36 may comprise a triangular configuration. Cutting element 36, instead of being disposed in a relatively deep pocket 34 and supported from the rear (taken in the direction of bit rotation) by a portion of the bit body, may extend slightly into a shallow pocket 34S and be supported from the rear at a discrete peripheral location by a gusset or buttress 240 extending at an acute angle from a major plane of cutting element 36 and formed of a material and configuration so that, when cutting element 236 is worn sufficiently, for example to a level L, the junction between cutting element 36 and gusset or buttress 240 will fail and the cutting structure will collapse. Thus, the area surrounding cutting elements 32 (not shown in FIGS. 13A and 13B) will be cleared to enhance hydraulic performance of the drill bit 12. The gusset or buttress 240 may comprise, for example, a strut of matrix material (tungsten carbide infiltrated with a binder, such as, by way of example only, copper alloy) comprising an extension of the bit body, or may comprise a preformed member of any material sufficiently robust to sustain force and impact loading encountered by cutting element 236 during drilling of casing components and associated material.

Figure 14A:
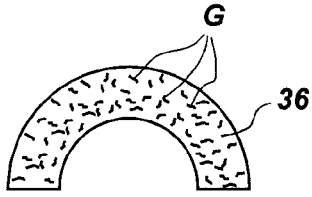
FIG. 14A is a schematic depiction of a superabrasive grit-impregnated cutting element suitable for drilling through a casing bit and/or, if present, cementing equipment components and associated materials within a casing.
Figure 14B:
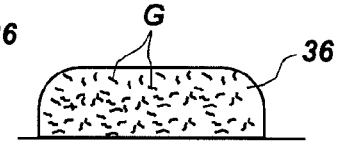
FIG. 14B is a schematic side elevation of a superabrasive grit-impregnated cutting element configured as a wear knot suitable for drilling through a casing bit and/or, if present, cementing equipment components and associated materials within a casing.
Figure 14C:
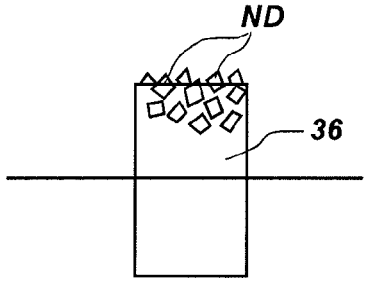
FIG. 14C is an elevation of a cutting element configured as a post, having a plurality of natural diamonds secured to the distal end thereof, and suitable for drilling through a casing bit and/or, if present, cementing equipment components and associated materials within a casing.

FIGS. 14A-14C depict further embodiments of cutting element 36. FIG. 14A depicts a cutting element 36 formed of a superabrasive material in the form of natural or synthetic diamond grit, or a combination thereof (either or both commonly identified as G, carried in a matrix material such as tungsten carbide. Such structures, as known in the art, may comprise sintered bodies, infiltrated bodies or hot isostatic pressed (HIP) bodies of any suitable configuration, that of FIG. 14A being only one non-limiting example. FIG. 14B depicts a cutting element 36 formed of a superabrasive material in the form of, natural or synthetic diamond grit or a combination thereof G carried in a matrix material such as tungsten carbide and configured as a wear knot. The wear knot may be formed as an integral part of a matrix-type bit body or preformed and secured, as in a pocket, to the bit face. FIG. 14C depicts a cutting element 36 configured as a post and including a plurality of natural diamonds ND on a distal end thereof. The material of the post may be, as with the wear knot configuration, formed of a matrix material. Further, the structure of FIG. 14C maybe configured as a wear knot in accordance with FIG. 14B, and the structure of FIG. 14B may be configured as a post in accordance with FIG. 14C. It is also contemplated that cubic boron nitride may be employed as a superabrasive material in lieu of diamond.

Any of the foregoing configurations for a cutting element 36 may be implemented in the form of a cutting element having a tough or ductile core coated on one or more exterior surfaces with a wear-resistant coating such as tungsten carbide or titanium nitride.

While examples of specific cutting element configurations for cutting casing-associated components and cement, on the one hand, and subterranean formation material on the other hand, have been depicted and described, the invention is not so limited. The cutting element configurations as disclosed herein are merely examples of designs, which the inventors believe are suitable. Other cutting element designs for cutting casing-associated components may employ, for example, a chamfer bridging between the side of the cutting element and the cutting face, rather than an offset chamfer, or no chamfer at all may be employed. Likewise, superabrasive cutting element design and manufacture is a highly developed, sophisticated technology, and it is well known in the art to match superabrasive cutting element designs and materials to a specific formation or formations intended to be drilled.

Figure 8:
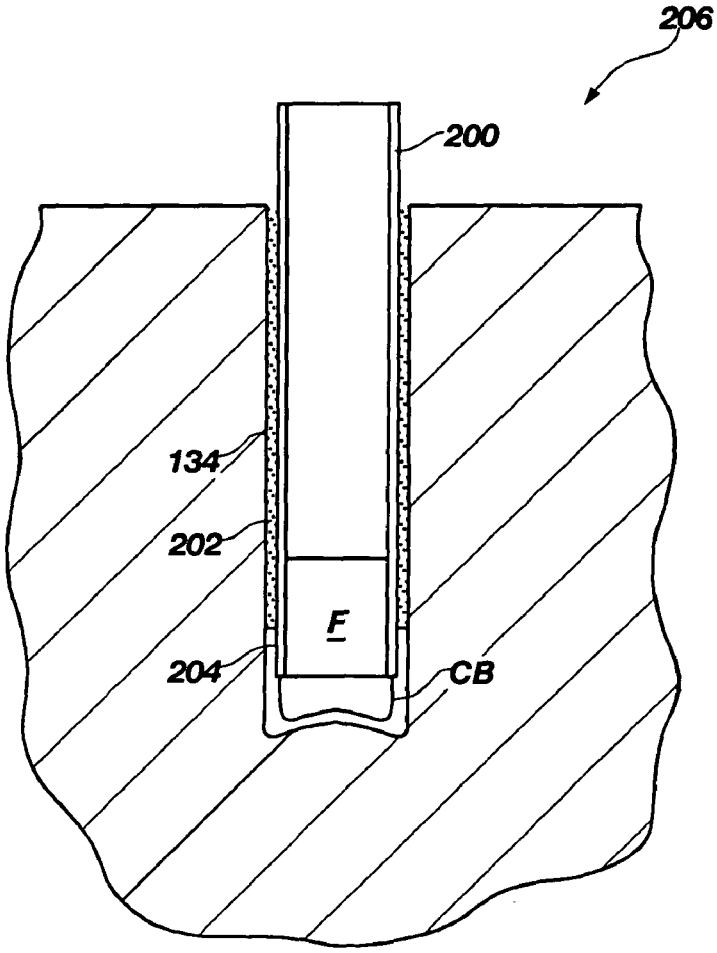
FIG. 8 shows schematically a casing assembly having a casing bit at the bottom thereof and a cementing equipment component assembly above the casing bit, the casing assembly disposed within a borehole.

As shown in FIG. 8, a casing section 200 and a casing bit CB disposed on the end 204 thereof may be surrounded by cement 202, or other hardenable material, so as to cement the casing bit CB and casing section 200 within borehole 134, after borehole 134 is drilled. Cement 202 may be forced through the interior of casing section 200, through (for example) apertures formed in casing bit CB, and into the annulus formed between the wall of borehole 134 and the outer surface of the casing section 200. Of course, conventional float equipment F as shown schematically above casing bit CB may be used for controlling and delivering the cement to the casing bit CB. Cementing the casing bit assembly 206 into the borehole 134 may stabilize the borehole 134 and seal formations penetrated by borehole 134. In addition, it may be desirable to drill past the casing bit CB, so as to extend the borehole 134, as described in more detail hereinbelow.

Casing bit CB may include an integral stem section S (see FIG. 9) extending longitudinally from the nose portion of casing bit CB that includes one or more frangible regions. Alternatively, flow control equipment F, such as float equipment, may be included within the integral stem section S of casing bit CB. Casing bit CB may include a threaded end for attaching the casing bit CB to a casing string, or it may be attached by another suitable technique, such as welding. Alternatively or additionally, casing bit CB may include, without limitation, a float valve mechanism, a cementing stage tool, a float collar mechanism, a landing collar structure, other cementing equipment, or combinations thereof, as known in the art, within an integral stem section S, or such components may be disposed within the casing string above casing bit CB.

More particularly, an integral stem section of casing bit CB may include, as a component assembly F, cementing float valves as disclosed in U.S. Pat. No. 3,997,009 to Fox and U.S. Pat. No. 5,379,835 to Streich, the disclosures of which are incorporated by reference herein. Further, valves and sealing assemblies commonly used in cementing operations as disclosed in U.S. Pat. No. 4,624,316 to Baldridge, et al. and U.S. Pat. No. 5,450,903 to Budde, the disclosures of each of which are incorporated by reference herein, may comprise component assembly F. Further, float collars as disclosed in U.S. Pat. No. 5,842,517 to Coone, the disclosure of which is incorporated in its entirety by reference herein, may comprise component assembly F. In addition, U.S. Pat. Nos. 5,960,881 to Allamon et al. and U.S. Pat. No. 6,497,291 to Szarka, the disclosures of which are incorporated in their entirety by reference herein, disclose cementing equipment, which may comprise component assembly F. Any of the above-referenced cementing equipment, or mechanisms and equipment as otherwise known in the art, may be included within integral stem section S and may comprise component F thereof.

Figure 9:
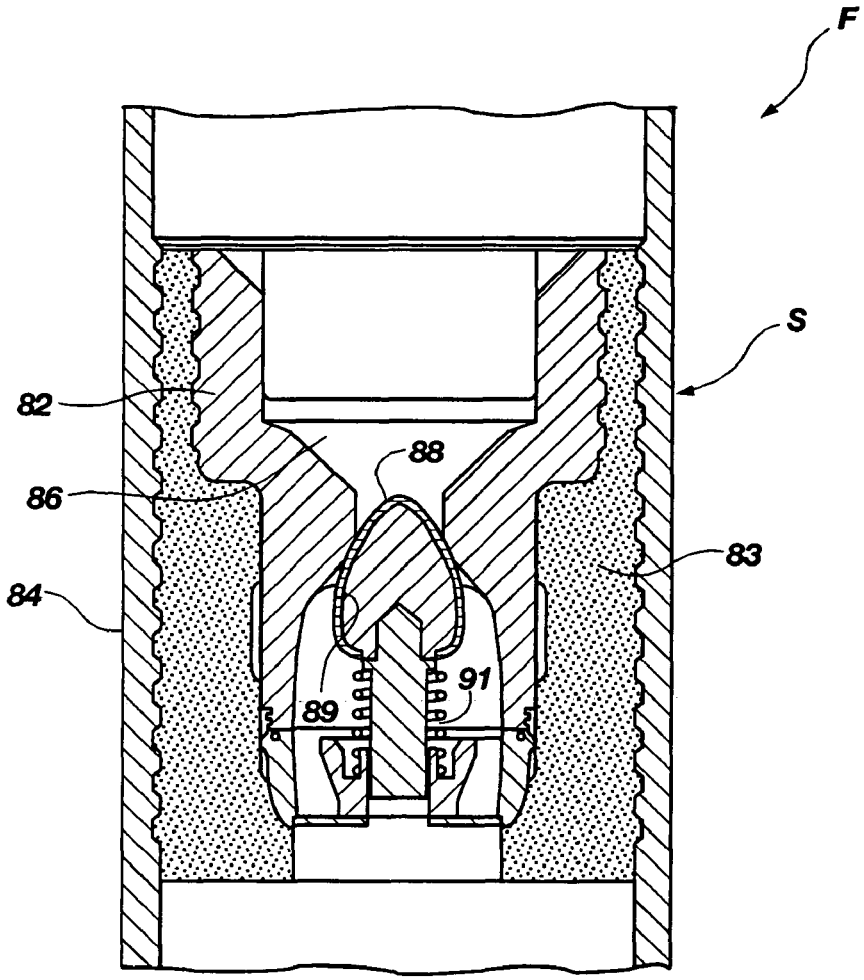
FIG. 9 shows a detailed, side cross-sectional view of an example cementing equipment component assembly such as might be used in the casing assembly of FIG. 7.

In one embodiment, component assembly F may comprise a float collar, as shown in FIG. 9, which depicts a partial side cross-sectional view of integral stem section S. As shown in FIG. 9, component assembly F may include an inner body 82 anchored within outer body 84 by a short column of cement 83, and having a bore 86 therethrough connecting its upper and lower ends. The bore 86 may be adapted to be opened and closed by check valve 88 comprising a poppet-type valve member 89 adapted to be vertically movable between a lower position opening bore 86 and an upper position closing bore 86, thus permitting flow downwardly therethrough, but preventing flow upwardly therethrough. Therefore, poppet-type valve member 89 may be biased to an upper position by biasing element 91, which is shown as a compression spring; however, other biasing mechanisms may be used for this purpose, such as a compressed gas or air cylinder or an arched spring. Thus, cement may be delivered through check valve 88 and through apertures (not shown) or frangible regions (not shown) formed within the integral stem section S or the integral casing bit CB, as discussed hereinabove.

After drilling borehole 134 using casing bit assembly 206 and cementing casing bit assembly within borehole 134, it may be desirable to drill through the end of casing bit assembly 206 and into the formation ahead of casing bit assembly 206, for which a drill bit of the present invention is especially suitable.

Figure 10:
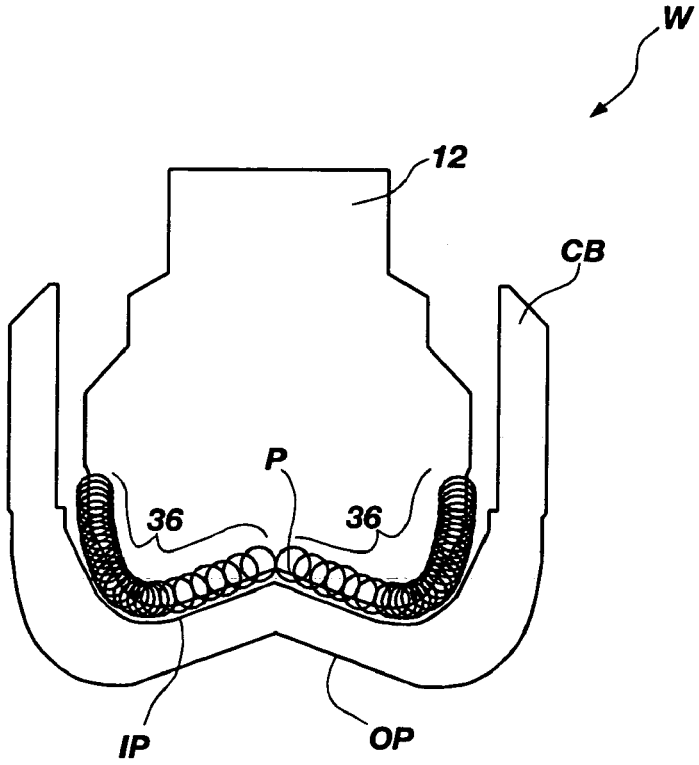
FIG. 10 shows a schematic cross-sectional view of a drill bit according to the present invention disposed within a casing bit having an inner profile as well as an outer profile substantially conforming to a drilling profile defined by cutting elements of the drill bit.

Referring to FIG. 10 of the drawings, as discussed above, a casing bit CB may be affixed to a casing section and cemented within a borehole or wellbore (not shown), as known in the art. FIG. 10 shows a partial cross-sectional embodiment of a portion of a wellbore assembly W and a drill bit 12 according to the present invention disposed within the interior of casing bit CB for drilling therethrough. Wellbore assembly W is shown without a casing section attached to the casing bit CB, for clarity. However, it should be understood that the embodiments of wellbore assembly W as shown in FIG. 10 may include a casing section, which may be cemented within a borehole as known in the art and as depicted in FIG. 8.

Generally, referring to FIG. 10, drill bit 12 may include a drilling profile P defined along its lower region that is configured for engaging and drilling through the subterranean formation. Explaining further, the drilling profile P of the drill bit 12 may be defined by cutting elements 36 that are disposed along a path or profile of the drill bit 12. Thus, the drilling profile P of drill bit 12 refers to the drilling envelope or drilled surface that would be formed by a full rotation of the drill bit 12 about its drilling axis (not shown). Of course, drilling profile P may be at least partially defined by generally radially extending blades 22 (not shown in FIG. 10, see FIGS. 1-3) disposed on the drill bit 12, as known in the art. Moreover, drilling profile P may include arcuate regions, straight regions, or both.

Casing bit CB may include an inner profile IP, which substantially corresponds to the drilling profile P of drill bit 12. Such a configuration may provide greater stability in drilling through casing bit CB. Particularly, forming the geometry of drilling profile P of drill bit 12 to conform or correspond to the geometry of the inner profile IP of casing bit CB may enable cutting elements 36 of relatively greater exposure disposed on the drill bit 12 to engage the inner profile IP of casing bit CB at least somewhat concurrently, thus equalizing the forces, the torques, or both, of cutting therethrough.

For instance, referring to FIG. 10, the drilling profile P of drill bit 12 substantially corresponds to the inner profile IP of casing bit CB, both of which form a so-called "inverted cone." Put another way, the drilling profile P slopes longitudinally upwardly from the outer diameter of the drill bit 12 (oriented as shown in the drawing figure) toward the center of the drill bit 12. Therefore, as the drill bit 12 engages the inner profile IP of casing bit CB, the drill bit 12 may be, at least partially, positioned by the respective geometries of the drilling profile P of the drill bit 12 and the inner profile IP of the casing bit CB. In addition, because the cutting elements 36 of the dill bit 12 contact the inner profile IP of the casing bit CB substantially uniformly, the torque generated in response to the contact may be distributed, to some extent, more equally upon the drill bit 12.

As also shown in FIG. 10, the outer profile OP of casing bit CB of wellbore assembly W may have a geometry, such as an inverted cone geometry, that substantially corresponds to the drilling profile P of drill bit 12. In FIG. 10, all the cutting elements 36 are shown on each side (with respect to the central axis of the drill bit 12) of the drill bit 12, and are shown as if all the cutting elements 36 were rotated into a single plane. Thus, the lower surfaces (cutting edge areas) of the overlapping cutting elements 36 form the drilling profile P of drill bit 12, the drilling profile P referring to the drilling envelope formed by a full rotation of the drill bit 12 about its drilling axis (not shown).

As a further aspect of the present invention, a casing bit of the present invention may be configured as a reamer. A reamer is an apparatus that drills initially at a first smaller diameter and subsequently at a second, larger diameter. Although the present invention may refer to a "drill bit," the term "drill bit" as used herein also encompasses the structures that are referred to conventionally as casing bits, reamers and casing bit reamers.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

What is claimed is:

1. A drill bit for use in drilling through casing components and associated material, the drill bit comprising at least one cutting element comprising:

a body at least substantially formed of carbide material and including a non-planar cutting face defined by a plurality of surfaces of the carbide material of the body, the cutting face comprising:

a plurality of at least one of scallops and teeth defined by adjacent surfaces of the plurality of surfaces of the carbide material of the body; and a plurality of cutting edges defined by apices between the adjacent surfaces defining the plurality of at least one of scallops and teeth;

wherein the at least one cutting element is configured and oriented on the drill bit to cause sequential exposure of edges of the plurality of cutting edges as the at least one cutting element wears during drilling.

2. The drill bit of claim 1, wherein the cutting face is configured with scallops, and the scallops are of sufficient size to cause at least one of the apices below a cutting edge to serve as a chip breaker.

3. A drill bit for use in drilling through casing components and associated material, the drill bit comprising:

a bit body; and a cutting element attached to the bit body, the cutting element comprising:

a cutting element body formed of an abrasive material;

wherein the cutting element body comprises a side portion interfacing and connected with the bit body; and a support structure extending rearwardly from the cutting element body to the bit body, the support structure configured to support a rear of the cutting element body at a peripheral location on the cutting element body during drilling, the support structure and the cutting element body configured to fail upon wear of the cutting element body of the cutting element to a selected level;

wherein a void is defined between the cutting element body, the support structure, and the bit body.

4. A method of drilling, comprising:

forming a cutting element of a first type comprising:

a body at least substantially formed of carbide material and including a non-planar cutting face defined by a plurality of surfaces of the carbide material of the body, the cutting face comprising:

a plurality of at least one of scallops and teeth defined by adjacent surfaces of the plurality of surfaces of the carbide material of the body; and a plurality of cutting edges defined by apices between the adjacent surfaces defining the plurality of at least one of scallops and teeth;

wherein the cutting element of the first type is configured and oriented on the drill bit to cause sequential exposure of edges of the plurality of cutting edges as the cutting element of the first type wears during drilling;

drilling through at least one component or material of a casing assembly to expose material of a subterranean formation using the cutting element of the first type, drilling through the at least one component or material of a casing assembly comprising:

engaging the at least one component or material of the casing assembly with a first cutting edge defined by an apex between adjacent surfaces of the plurality of surfaces of the cutting element of the first type; and wearing the first cutting edge of the cutting element of the first type away to an extent sufficient at least to cause a second cutting edge of the cutting element of the first type to engage the at least one component or material of the casing assembly;

engaging the exposed material of the subterranean formation with the cutting element of the first type and wearing the cutting element of the first type away to an extent sufficient at least to cause a cutting element of a second, different type to engage with the subterranean formation; and drilling a wellbore into the subterranean formation using the cutting element of the second, different type.

* * * * *